US007921796B1

(12) United States Patent
Perry, Jr.

(10) Patent No.: US 7,921,796 B1
(45) Date of Patent: Apr. 12, 2011

(54) COLLAPSIBLE ARCH BAR

(76) Inventor: John S. Perry, Jr., Englewood, FL (US)

( * ) Notice: Subject to any disclaimer, the term of this patent is extended or adjusted under 35 U.S.C. 154(b) by 505 days.

(21) Appl. No.: 12/017,090

(22) Filed: Jan. 21, 2008

Related U.S. Application Data

(60) Provisional application No. 60/881,984, filed on Jan. 23, 2007.

(51) Int. Cl.
*B63B 17/00* (2006.01)
*B63B 17/02* (2006.01)
*E04H 15/06* (2006.01)

(52) U.S. Cl. ..... 114/361; 114/343

(58) Field of Classification Search ..... 114/343, 114/361, 364
See application file for complete search history.

(56) References Cited

U.S. PATENT DOCUMENTS 5,044,298 A * 9/1991 Pepper et al. ..... 114/361
5,803,104 A * 9/1998 Pollen ..... 135/96
6,666,163 B2 * 12/2003 Pastor et al. ..... 114/361
7,654,216 B2 * 2/2010 Grieger ..... 114/361

* cited by examiner

*Primary Examiner* — Ajay Vasudeva
(74) *Attorney, Agent, or Firm* — Kenneth L Tolar

(57) ABSTRACT

A collapsible arch bar for a water craft includes a pair of side arms pivotally attached to the gunnels on the water craft. A cover member is pivotally attached to the upper ends of the side arms allowing the arch bar to be collapsed rearwardly if the craft is approaching an overhead obstruction. An automated lifting means allows the water craft operator to automatically collapse and re-erect the arch bar, if desired.

4 Claims, 3 Drawing Sheets

COLLAPSIBLE ARCH BAR

CROSS REFERENCE TO RELATED APPLICATIONS

This application is entitled to the benefit of provisional application No. 60/881,984 filed on Jan. 23, 2007, the specification of which is incorporated herein by reference.

BACKGROUND OF THE INVENTION

The present invention relates to a collapsible arch bar for a recreational water craft that allows the craft to travel beneath bridges and other low-lying obstructions.

DESCRIPTION OF THE PRIOR ART

Many recreational water craft, such as yachts, are equipped with an upwardly-extending, U-shaped arch bar. Due to its height, the bar cannot always clear low bridges or other overhead obstructions thereby requiring the craft to be rerouted, which is burdensome and inconvenient. Accordingly, there is currently a need for a device that allows an arch bar to clear an overhead obstruction. The present invention addresses this need by providing a hinged arch bar that can be collapsed whenever the associated water craft must clear an overhead obstruction.

SUMMARY OF THE INVENTION

A collapsible arch bar for a water craft includes a pair of side arms pivotally attached to the gunnels on the water craft. A cover member is pivotally attached to the upper ends of the side arms allowing the arch bar to be collapsed rearwardly if the craft is approaching an overhead obstruction. An automated lifting means allows the water craft operator to automatically collapse and re-erect the arch bar, if desired.

It is therefore an object of the present invention to provide an arch bar that can be temporarily collapsed to clear an overhead obstruction.

It is another object of the present invention to provide an arch bar that can be automatically collapsed and re-erected with an automated lifting means.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
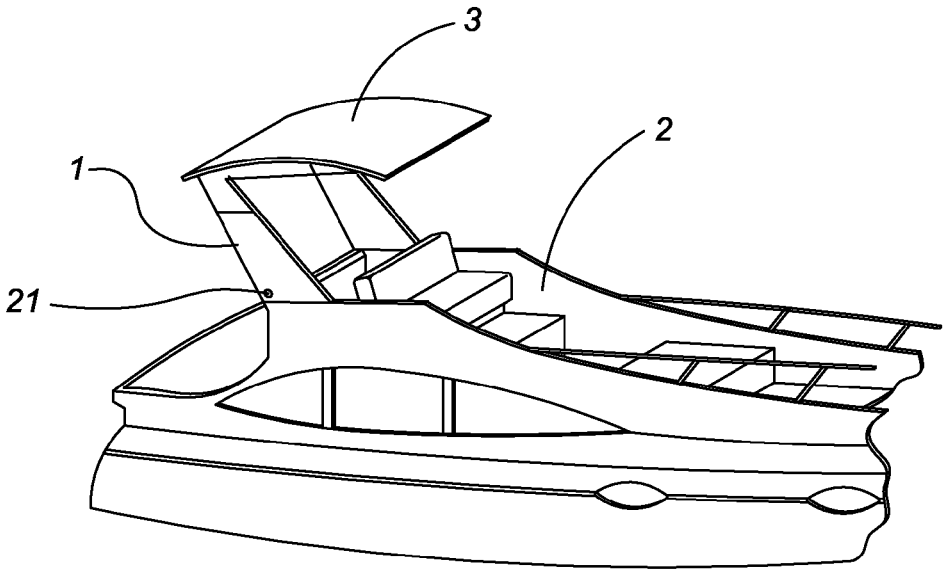
FIG. 1 depicts the arch bar according to the present invention in an upright, operable position.
Figure 2:
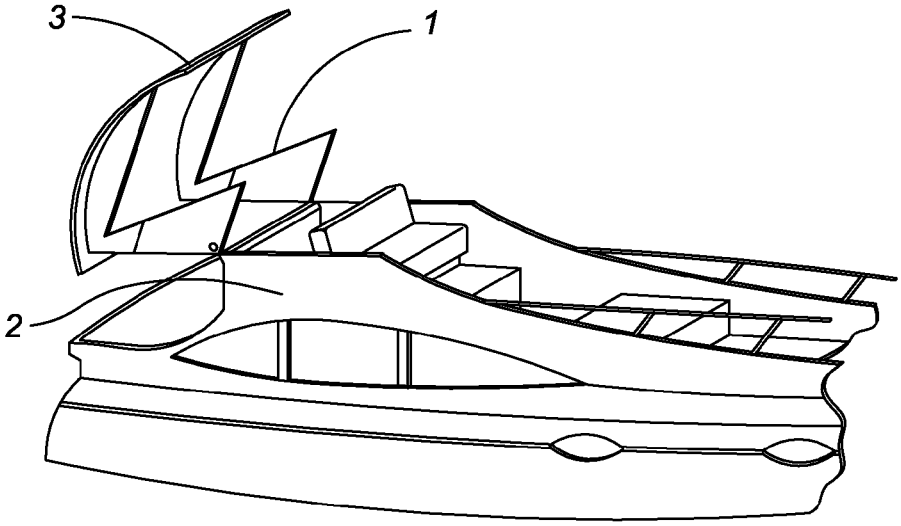
FIG. 2 depicts the arch bar of FIG. 1 in a partially collapsed position.
Figure 3:
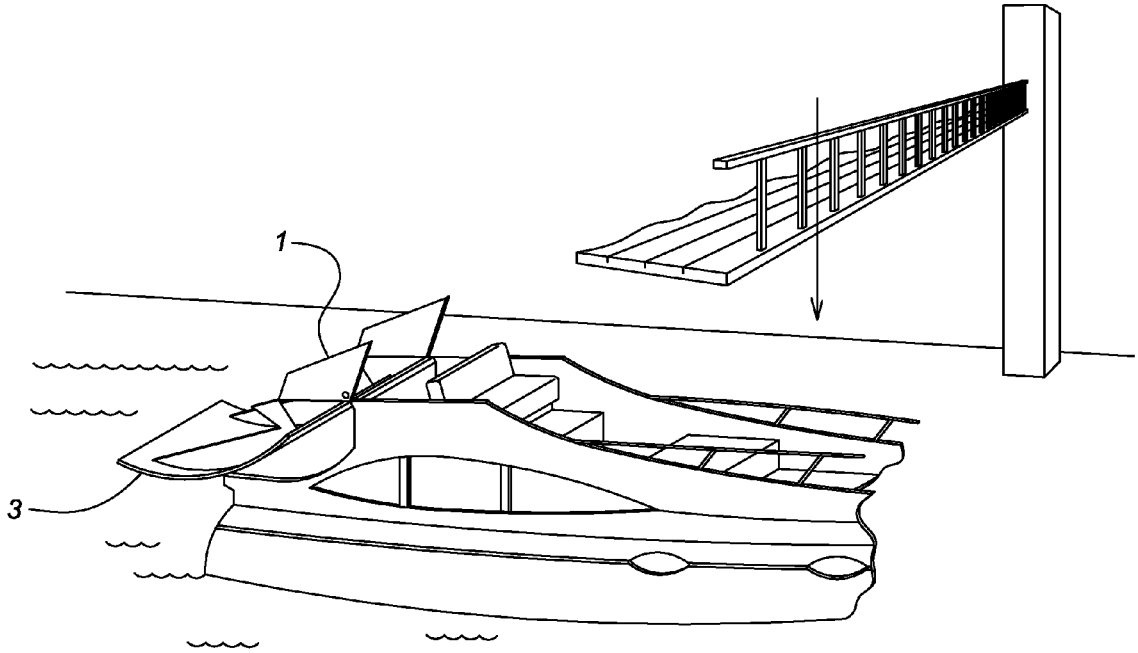
FIG. 3 depicts the arch bar in a completely collapsed position.

A collapsible arch bar according to a first embodiment includes a pair of spaced side arms 1 each having a lower end and an upper end. The lower end of each arm is pivotally attached to the upper edge of one of the gunnels 2 on a water craft. Extending from the upper end of one of the side arms to the upper end of the other is a substantially planar, pivotal cover member 3 that may be folded onto the arms as depicted in FIGS. 2 and 3. The above-described arch bar may be manually collapsed toward the rear of a vessel when approaching an overhead obstruction. Preferably, the pivotal sections include locking pins 21 or push button latches to releasably secure the sections in an erect orientation.

Figure 4:
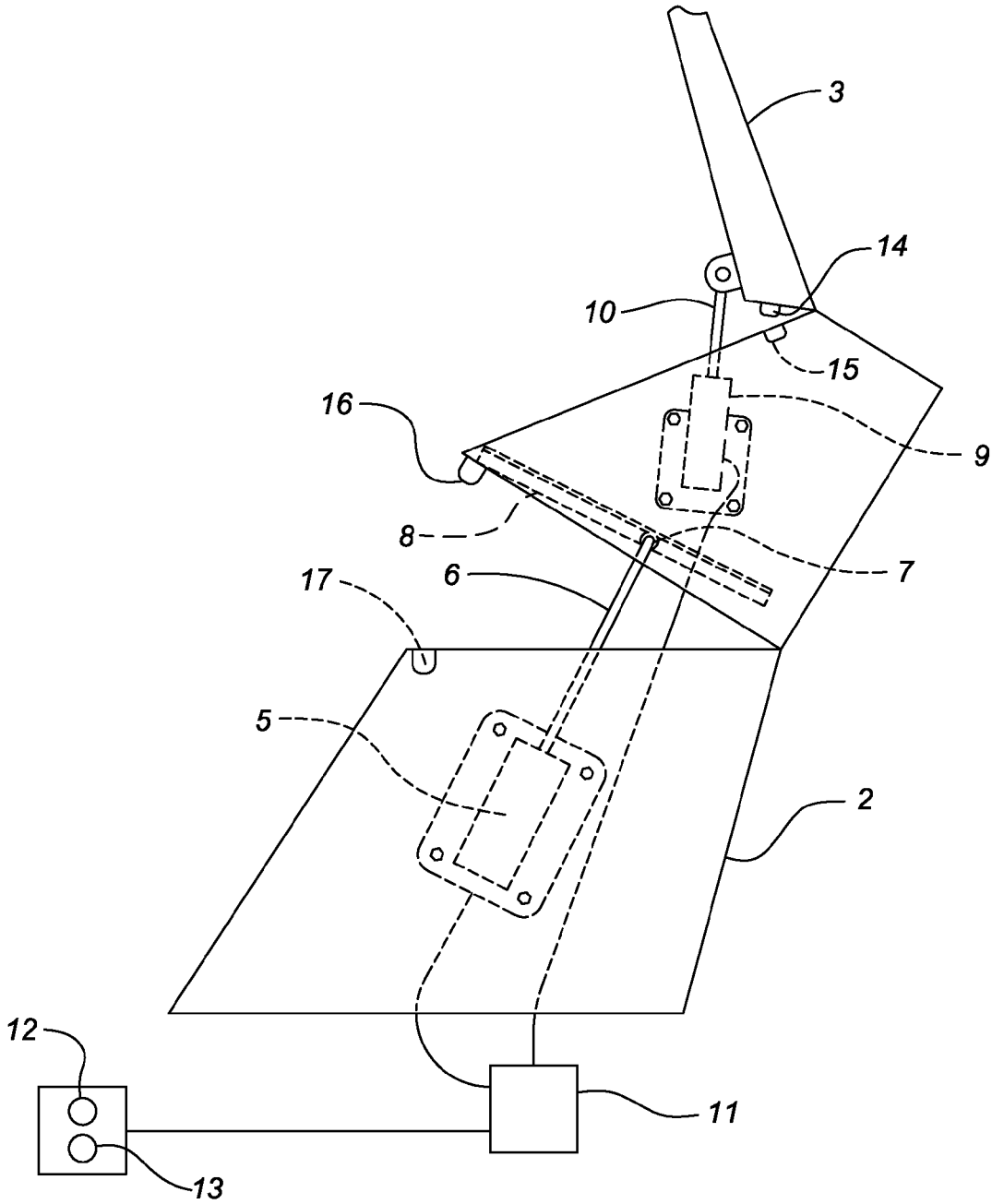
FIG. 4 is a side, sectional view one of the arch bar arms being pivoted rearwardly.

Now referring to FIG. 4, the above-described device may also include a lifting means for automatically collapsing and re-erecting the arch bar; the lifting means includes a first hydraulic cylinder 5 attached to the boat's gunnel, having a telescoping piston 6 extending therefrom. A roller 7 at an upper end of the piston glides within a guide track 8 positioned on the inwardly facing side of the arm. A second hydraulic cylinder 9 is mounted on one of the arms and includes a telescoping piston pivotally 10 attached to the lower surface of the cover. A hydraulic pump 11 is positioned beneath the gunnel or is otherwise mounted within the boat for delivering motive fluid to the cylinders. An "UP" button 12 causes the pump to deliver fluid to the cylinders while a "DOWN" button 13 drains the cylinders, allowing a user to easily collapse or re-erect the arch bar by pushing one of the buttons.

The cover includes at least one protrusion 14 that seats within a mating receptacle 15 at the upper end of each arm; likewise, the lower end of each arm includes a protrusion 16 that seats within a receptacle 17 on the upper end of the gunnel.

Accordingly, when the water craft operator approaches an overhead obstruction, he or she simply depresses the "UP" button to collapse the arch bar toward the rear of the craft. Once the craft has cleared the obstruction, the operator depresses the "DOWN" button to reorient the arch bar in its original upright position.

The above-described device is not limited to the exact details of construction and enumeration of parts provided herein. For example, though the device has been depicted and described as only one of the arms having hydraulic lifting cylinders, both side arms may be so equipped. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A collapsible arch bar comprising:

a pair of spaced side arms each having a lower end and an upper end, the lower end of each side arm pivotally attached to a water craft;

a substantially planar, pivotal cover member pivotally attached to the upper end of each of said side arms, said cover member having a lower surface whereby said cover is foldable onto the arms and said arms are foldable relative to said water craft to allow the water craft to clear an overhead obstruction;

a first hydraulic cylinder attached to said water craft, said first hydraulic cylinder having a telescoping piston extending therefrom, said piston having an upper end slidably mounted on either of said side arms;

a second hydraulic cylinder attached to either of said side arms, said second hydraulic cylinder having a telescoping piston pivotally attached to the lower surface of the cover;

means for reversibly delivering hydraulic fluid to each of said cylinders allowing a user to easily collapse and re-erect the arch bar.

2. The arch bar according to claim 1 further comprising a locking means for securing said arms and said cover in an erect orientation.

3. The arch bar according to claim 1 wherein said cover includes a protrusion on the lower surface thereof that seats within a mating receptacle at the upper end of each arm.

4. The arch bar according to claim 1 wherein the lower end of each arm includes a protrusion that seats within a receptacle formed on said water craft.

* * * * *